US008042319B2

(12) United States Patent
Liu et al.

(10) Patent No.: US 8,042,319 B2
(45) **Date of Patent: *Oct. 25, 2011**

(54) VACUUM PACKAGING SYSTEM

(75) Inventors: Peng Liu, Beijing (CN); Pi-Jin Chen, Beijing (CN); Bing-Chu Du, Beijing (CN); Cai-Lin Guo, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 209 days.

This patent is subject to a terminal disclaimer.

(21) Appl. No.: 12/469,833

(22) Filed: May 21, 2009

(65) Prior Publication Data

US 2009/0288364 A1 Nov. 26, 2009

(30) Foreign Application Priority Data

May 23, 2008 (CN) ..... 2008 1 0067427

(51) Int. Cl.
*B65B 55/00* (2006.01)

(52) U.S. Cl. ..... 53/510; 53/80; 53/86; 53/127

(58) Field of Classification Search ..... 53/80, 83, 53/84, 86, 107, 110, 127, 509, 510
See application file for complete search history.

(56) References Cited

U.S. PATENT DOCUMENTS 3,477,192 A 11/1969 Brown et al.
3,826,634 A 7/1974 Blust et al.
3,830,365 A 8/1974 Krueger et al.
3,910,008 A 10/1975 Johnson
3,914,000 A 10/1975 Beckerman et al.
3,926,306 A 12/1975 Van Nederveen
4,135,789 A * 1/1979 Hall ..... 349/154
4,418,511 A 12/1983 Collin
4,582,210 A 4/1986 Morimoto et al.
4,748,797 A 6/1988 Martin
4,770,310 A 9/1988 Morimoto et al.
5,072,574 A 12/1991 Puett
5,246,042 A * 9/1993 Farrell ..... 141/59
5,269,351 A * 12/1993 Yoshihara ..... 141/7
5,271,207 A 12/1993 Epstein et al.
5,587,622 A 12/1996 Mohacsi
5,759,668 A 6/1998 Ishikawa et al.
5,797,780 A 8/1998 Peng
5,896,727 A 4/1999 Egli et al.
5,921,837 A 7/1999 Kanagawa et al.
5,964,630 A 10/1999 Slusarczuk et al.
6,128,066 A * 10/2000 Yokozeki ..... 349/187
6,147,450 A 11/2000 Fritz et al.
6,416,831 B1 7/2002 Hara et al.
6,457,299 B1 10/2002 Schwenke et al.
6,735,845 B2 5/2004 Jonsson (Continued)

*Primary Examiner* — Thanh Truong
(74) *Attorney, Agent, or Firm* — Altis Law Group, Inc.

(57) ABSTRACT

A vacuum packaging system includes a vacuum room, a delivery apparatus, a discharge device, a second heating apparatus. The delivery apparatus transport the pre-packaged container into the vacuum room. The discharge device discharges a sealing material to seal an exhaust through hole of the pre-packaged container. The discharge device includes a vessel configured for containing sealing material, a transport pipeline, a first heating, and a controlling element. The first heating apparatus softens the sealing material into viscous liquid. The second heating apparatus is mounted on the inner wall of the vacuum room between the second hatch and the transport pipeline.

13 Claims, 2 Drawing Sheets

U.S. PATENT DOCUMENTS 6,748,726 B2 6/2004 Rossi et al.
6,843,043 B2 1/2005 Hanson et al.
7,055,298 B2 6/2006 Rossi et al.
7,081,029 B2 7/2006 Tagawa et al.
7,758,396 B2 7/2010 Okawa et al.
2009/0288363 A1* 11/2009 Liu et al. ..... 53/80
2009/0288364 A1 11/2009 Liu et al.

* cited by examiner

VACUUM PACKAGING SYSTEM

RELATED APPLICATIONS

This application is related to commonly-assigned application: U.S. patent application Ser. No. 12/469,829, entitled, "VACUUM PACKAGING SYSTEM", filed concurrently. The disclosures of the above-identified applications are incorporated herein by reference.

BACKGROUND

1. Technical Field

The present disclosure relates to packaging technology and, in particular, to a vacuum packaging system for a vacuum device.

2. Description of the Related Art

Some vacuum devices, such as flat panel displays, are packaged by a vacuum packaging system to create a vacuum within such devices. Referring to FIG. 2, according to the prior art, a typical vacuum packaging system 300 is shown. The typical vacuum packaging system 300 includes a vacuum room 30, a first accommodating room 31 and a second accommodating room 32 disposed at opposite sides of the vacuum room 30, a delivery device 35, and a sealing device 36 connected to the vacuum room 30. The first accommodating room 31 and the second accommodating room 32 communicate with the vacuum room 30 via a first hatch 33 and a second hatch 34. The delivery device 35 can carry workpieces to be packaged between the first and second accommodating rooms 31, 32. The sealing device 36 is located outside the vacuum room 30 and emits a laser to package the workpieces.

The packaging method utilizing the above vacuum packaging system 300 includes the following steps. A pre-packaged container 37, that has an exhaust through hole 371 defined thereon, is prepared in the first accommodating room 31. An exhaust pipe 372 is provided. One end of the exhaust pipe 372 is inserted into and fixed in the exhaust through hole 371 via low-melting glass powder (not labeled), and another end of the exhaust pipe 372 is exposed outside the pre-packaged container 37. The sealing device 36 heats and softens the exhaust pipe 372 so as to seal the open end thereof. The pre-packaged container 37 and the exhaust pipe 372 fixed on the pre-packaged container 37 are transported into the vacuum room 30 via the delivery device 35. The vacuum room 30 is connected to a vacuum pump 38 that is used to create a vacuum. The outer end of the exhaust pipe 372 is then sealed utilizing the sealing device 36. The packaged container (not labeled) is cooled in the second accommodated room 32 to obtain a packaged container under vacuum.

However, the exhaust pipe 372 needs to be disposed at the through hole 371 of the pre-packaged container 37 in the above method. In addition, the exhaust pipe 372 is retained outside of the packaged container, which is disadvantageous with respect to safety and reliability. Furthermore, to expediently seal the end of the exhaust pipe 372, the exhaust pipe 372 should have a small diameter, for example, less than 5 mm, which results in more time to remove air from the pre-packaged container 37. Therefore, the structure of the packaged container becomes complicated and the manufacturing cost is increased.

What is needed, therefore, is a vacuum packaging system for a vacuum device, which can overcome the above-described shortcomings.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments.

DETAILED DESCRIPTION

Figure 1:
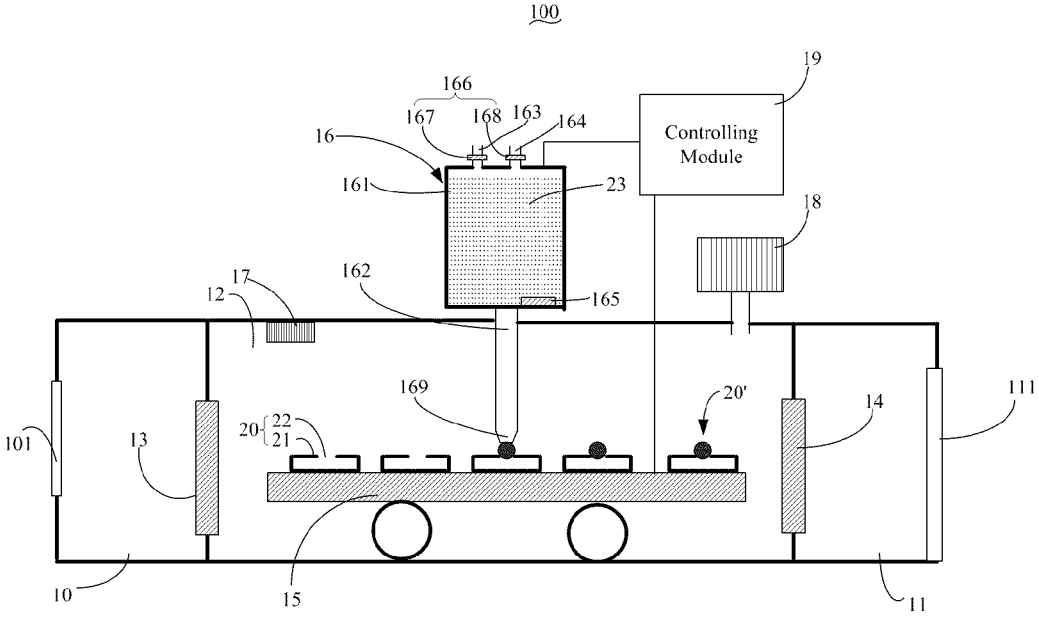
FIG. 1 is a schematic, cross-sectional view of an embodiment a vacuum packaging system.
Figure 2:
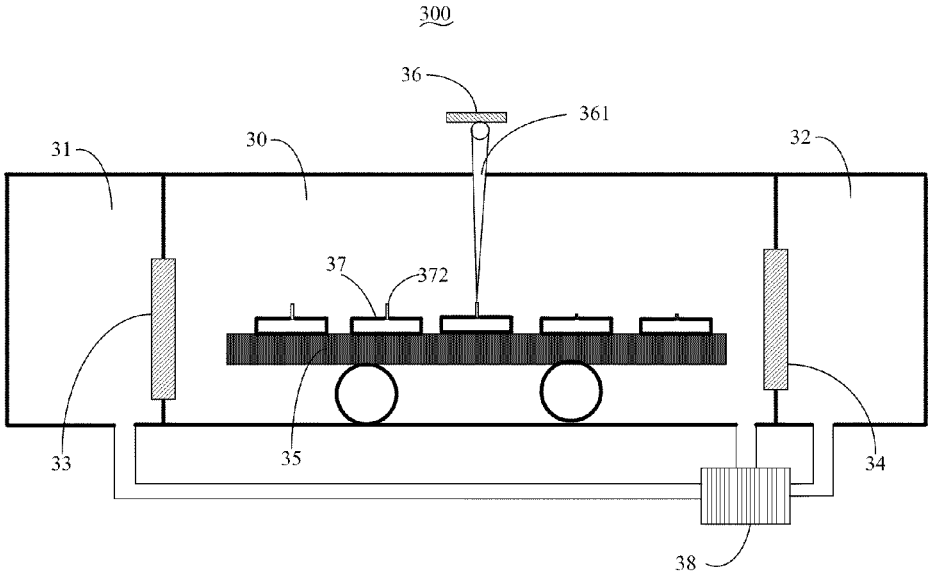
FIG. 2 is a schematic, cross-sectional view of a typical vacuum packaging system.

Referring to FIG. 1, an embodiment of a vacuum packaging system 100 includes a first accommodating room 10, a second accommodating room 11, a vacuum room 12, a first hatch 13, a second hatch 14, a delivery apparatus 15, a discharge device 16, and a first heating apparatus 17. The vacuum room 12 is sandwiched between the first accommodating room 10 and the second accommodating room 11. The first hatch 13 is interposed between the first accommodating room 11 and the vacuum room 12. The second hatch 14 is interposed between the second accommodating room 11 and the vacuum room 12. The delivery apparatus 15 is used to transport a plurality of pre-packaged containers 20 into the vacuum room 12 from the first accommodating room 10 and delivering the packaged containers 20' out of the vacuum room 12 to the second accommodating room 11. The discharge device 16 is mounted outside the vacuum room 12 with a part of the discharge device 16 extending into the vacuum room 12 and communicates with the vacuum room 12. The first heating apparatus 17 is disposed on an inner side of the vacuum room 12 between the first accommodating room 10 and the discharge device 16.

Each of the pre-packaged containers 20 includes a housing 21 and an exhaust through hole 22 defined in any one sidewall of the housing 21. The housing 21 may be made of glass, metal, or any material that can be adhered utilizing low-melting glass powder. In the present embodiment, the housing 21 is comprised of glass. The pre-packaged container 20 can be, for example, an element of a flat panel display, and the housing 21 can include a rear plate, a front plate and spacers disposed between the rear plate and the front plate. Some electronic elements (not shown) are contained in the housing 21. The exhaust through hole 22 can have any size and shape that is appropriate to the volume of the housing 21. In the present embodiment, the exhaust through hole 22 has a circular shape and has a diameter of about 2 mm to about 10 mm. However, it is understood that if the exhaust through hole 22 has too large of a diameter, a poor reliability would result.

The first accommodating room 10 includes a first door 101. The first door 101 allows the pre-packaged containers 20 to be fed into the first accommodating room 10 therethrough. The first accommodating room 10 is used for placing the pre-packaged containers 20 on the delivery apparatus 15.

The second accommodating room 11 includes a second door 111. The second door 111 allows the packaged containers 20' to exit from the second accommodating room 11 therethrough. The second accommodating room 11 is arranged to allow the packaged containers 20' to cool.

The vacuum room 12 is used for providing a sealing room to contain the delivery apparatus 15 and perform the heating, exhausting, and packaging of the pre-packaging containers 20 therein utilizing sealing material 23.

The first hatch 13 and the second hatch 14 have the same configurations and work principles. In the present embodiment, the first hatch 13 is presented only as an example to explain the configurations and the work principles thereof. The first hatch 13 may be an automatic door to communicate the first accommodating room 10 to the vacuum room 12.

When the first hatch 13 is opened, the first accommodating room 10 communicates with the vacuum room 12 so that the delivery apparatus 15 can enter the vacuum room 12. Once the delivery apparatus 15 is fully contained in the vacuum room 12, the first hatch 13 is closed, and the vacuum room 12 is sealed off from the first accommodating room 10 and becomes a sealed room. After packaging is finished, the second hatch 14 is opened, such that the second accommodating room 11 communicates with the vacuum room 12, and the delivery apparatus 15 can exit the vacuum room 12 so that the packaged containers 20' can be cooled in the second accommodating room 11. When the delivery apparatus 15 is completely in the second accommodating room 11, the second hatch 14 is closed so that the second accommodating room 11 is sealed off from the vacuum room 12.

The delivery apparatus 15 may be a tray having wheels and can be driven to transport the pre-packaged containers 20 and the packaged containers 20' from the first accommodating room 10 to the second accommodating room 11. The delivery apparatus 15 can carry more than one pre-packaged containers 20 at one times so that the pre-packaged containers 20 can be packaged in batches in the vacuum room 12 to increase packaging efficiency.

The discharge device 16 includes a vessel 161, a transport pipeline 162 connected to the vessel 161, an air inlet 163, an air exhaust 164, a second heating apparatus 165, and a controlling element 166. The vessel 161 contains the sealing material 23. The sealing material 23 may be in powder form before being heated and melted, and may be made from materials such as aluminum oxide, aluminum fluoride, fluorinated ammonia, or calcium fluoride. The transport pipeline 162 is inserted through the vacuum room 12 and discharges one drop of the molten sealing material 23 on the exhaust through hole 22 to seal the pre-packaged containers 20. The transport pipeline 162 has a nozzle 169 defined on an end thereof far away from the vessel 161. The nozzle 169 has a diameter greater than that of the exhaust through hole 22 so that a drop of molten sealing material 23 transmitted by the transport pipeline 162 can completely seal the exhaust through hole 22. The air inlet 163 allows gas to flow into the vessel 161 to increase the pressure in the vessel 161 so as to eject the drop of the molten sealing material 23 into the vacuum room 12 for each pre-packaged container 20. The air exhaust 164 vents gas from the vessel 161 to decrease the pressure therein so as to prevent additional drops of molten sealing material 23 from dropping from the nozzle 169 to each of the pre-packaged container 20. The controlling element 166 is located on the transport pipeline 162 and configured to allow only one drop of the molten sealing material 23 to be transport into the vacuum room 12 for each pre-packaged container 20. The controlling element 166 includes a first valve 167 and a second valve 168. The first valve 167 is disposed on the air inlet 163, and the second valve 168 is disposed on the air exhaust 164. In use, for example, an inert gas is sent into the vessel 161, such that one drop of the molten sealing material 23 is transmitted into the vacuum room 12 and onto the exhaust through hole 22. Once the molten sealing material 23 has been dropped onto the exhaust through hole 22, the first valve 167 is closed and the second valve 168 is opened, and the vessel 161 is, at the least, partially evacuated via the air exhaust 164 until the vessel 161 has the same pressure as the vacuum room 12. Thus, the molten sealing material 23 cannot continue to drop into the vacuum room 12. The pre-packaged container 20, with the sealing material 23 placed on the exhaust through hole 22, becomes the packaged container 20', and transported to the second accommodating room 11 to be cooled. The second heating apparatus 165 may be an electric heating wire, an infrared light, or a laser. The second heating apparatus 165 is located in the vessel 161 and used for heating and melting the sealing material 23 to a molten state.

The first heating apparatus 17 may be an electrically heating wire, an infrared light, or a laser. The first heating apparatus 17 is disposed between the transport pipeline 162 and the first hatch 13 to bake the pre-packaged containers 20 so as to exhaust the vapor gas out thereof.

The vacuum packaging system 100 also includes a vacuum pump 18 connected to the vacuum room 12. When the delivery apparatus 15 enters the vacuum room 12 and the first and second hatches 13, 14 are closed, the vacuum pump 18 generates a vacuum in the vacuum room 12 and in the pre-packaged containers 20.

Furthermore, the vacuum packaging system 100 includes a controlling module 19 electrically connected to the discharge device 16 and the delivery apparatus 15. The controlling module 19 controls the ejection time of the sealing material 23 and the location of the delivery apparatus 15 such that the exhaust through hole 22 of each of the pre-packaged containers 20 is perfectly sealed.

In use, when the delivery apparatus 15 enters the vacuum room 12, the controlling module 19 controls the location of the pre-packaged containers 20, by aligning the exhaust through hole 22 with the transport pipeline 162. The controlling module 19 then controls the discharge device 16 to transport one drop of the molten sealing material 23 to drop and seal the exhaust through hole 22. After all of the pre-packaged containers 20 have been packaged, the delivery apparatus 15 enters the second accommodating room 11 where the packaged containers 20' are cooled. After the packaged containers 20' have been cooled, the package containers 20' are removed from the second accommodating room 12.

Since the molten sealing material 23 is used for sealing the exhaust through hole 22 of the pre-packaged container 20, no tail of the exhaust pipe is retained outside of the packaged container 20', which is advantageous from a safety and reliability standpoint. Furthermore, the vacuum packaging system 100 is appropriate for pipeline operations. Therefore, the structure of the vacuum devices is simple and safe and manufacturing cost is decreased.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A vacuum packaging system for packaging a pre-packaged container and establishing a vacuum in a packaged vacuum device, the packaged vacuum device comprising the pre-packaged container having an exhaust through hole defined therein, and a sealing material, the vacuum packaging system comprising:

a vacuum room to package the pre-packaged container;

a delivery apparatus to transport the pre-packaged container into the vacuum room and transport the packaged vacuum device out of from the vacuum room;

a discharge device to discharge the sealing material to seal the exhaust through hole of the pre-packaged container, the discharge device being mounted on the vacuum room, the discharge device comprising a vessel containing the sealing material, a transport pipeline connected to the vessel and extending into the vacuum room, a second heating apparatus disposed in the vessel, and a controlling element located on the vessel to control the sealing material to be transmitted into the vacuum room, the second heating apparatus to soften the sealing material;

a first heating apparatus mounted on an inner side of the vacuum room to bake the pre-packaged container to exhaust vapor gas out thereof.

2. The vacuum packaging system as claimed in claim 1, wherein the first heating apparatus is selected from the group consisting of an electrically heating wire, an infrared light, and a laser.

3. The vacuum packaging system as claimed in claim 1, wherein the second heating apparatus is selected from the group consisting of an electrically heating wire, an infrared light, and a laser.

4. The vacuum packaging system as claimed in claim 1, further comprising a vacuum pump connected to the vacuum room to generate a vacuum therein.

5. The vacuum packaging system as claimed in claim 1, wherein the discharge device further comprises an air inlet connected to the vessel to allow gas into the vessel, and an air exhaust connected to the vessel to allow gas out from the vessel.

6. The vacuum packaging system as claimed in claim 5, wherein the controlling element comprises a first valve and a second valve, the first valve is disposed in the air inlet and the second valve is disposed in the air exhaust.

7. The vacuum packaging system as claimed in claim 6, wherein the gas sent by the air inlet is an inert gas.

8. The vacuum packaging system as claimed in claim 1, further comprising a first accommodating room disposed on a first side of the vacuum room, and a first hatch interposed between the first accommodating room and the vacuum room, wherein the first accommodating room comprises a first door to provide an entrance into the first accommodating room.

9. The vacuum packaging system as claimed in claim 1, further comprising a second accommodating room disposed on a second side of the vacuum room and a second hatch interposed between the second accommodating room and the vacuum room, wherein the second accommodating room comprises a second door provide an entrance into the second accommodating room.

10. The vacuum packaging system as claimed in claim 1, further comprising a controlling module electrically connected to the discharge device and the delivery apparatus, the controlling module controls the ejection time of the molten sealing material and stop location of the delivery apparatus so that the molten sealing material is positioned on the exhaust through hole of the pre-packaged container.

11. The vacuum packaging system as claimed in claim 1, wherein the sealing material is made from materials selected from the group consisting of aluminium oxide, aluminum fluoride, fluorinated ammonia, and calcium fluoride.

12. The vacuum packaging system as claimed in claim 1, wherein the transport pipeline has a nozzle defined on an end thereof.

13. The vacuum packaging system as claimed in claim 12, wherein the nozzle has a diameter greater than that of the exhaust through hole.

* * * * *